US007017496B2

(12) United States Patent
Lloyd

(10) Patent No.: US 7,017,496 B2
(45) Date of Patent: Mar. 28, 2006

(54) KINETIC ENERGY ROD WARHEAD WITH IMPLODING CHARGE FOR ISOTROPIC FIRING OF THE PENETRATORS

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 20 days.

(21) Appl. No.: 10/385,319

(22) Filed: Mar. 10, 2003

(65) Prior Publication Data

US 2004/0129162 A1 Jul. 8, 2004

Related U.S. Application Data

(60) Provisional application No. 60/406,828, filed on Aug. 29, 2002.

(51) Int. Cl.
*F42B 12/22* (2006.01)

(52) U.S. Cl. ..... 102/494; 102/475

(58) Field of Classification Search ..... 102/473, 102/475, 476, 492, 494, 506, 478, 489
See application file for complete search history.

(56) References Cited

U.S. PATENT DOCUMENTS

| | | | | |
|---|---|---|---|---|
| 1,198,035 | A | 9/1916 | Huntington | |
| 1,229,421 | A | 6/1917 | Downs | |
| 1,235,076 | A | 7/1917 | Stanton | |
| 1,244,046 | A | 10/1917 | Ffrench | |
| 1,300,333 | A | 4/1919 | Berry | |
| 1,305,967 | A * | 6/1919 | Hawks | 102/494 |
| 2,296,980 | A | 9/1942 | Carmichael | |
| 2,308,683 | A | 1/1943 | Forbes | |
| 2,322,624 | A | 6/1943 | Forbes | |
| 2,337,765 | A | 12/1943 | Nahimey | |

(Continued)

FOREIGN PATENT DOCUMENTS

| | | | |
|---|---|---|---|
| DE | 3327043 | A1 | 2/1985 |
| DE | 38 30 527 | A1 | 3/1990 |
| DE | 3934042 | A1 | 4/1991 |
| EP | 270 401 | A1 | 6/1988 |
| FR | 2 678 723 | | 1/1993 |
| FR | 2678723 | A1 * | 1/1993 |
| GB | 550001 | | 12/1942 |
| GB | 2236581 | | 4/1991 |
| JP | 1-296100 | | 11/1989 |
| WO | WO 97/27447 | | 7/1997 |

OTHER PUBLICATIONS

Richard M. Lloyd, "Aligned Lethality Enhancement Concept for Kill Vehicles", 10th AIAA/BMDD Technology Conf., Jul. 23–26, Williamsburg, Virginia, 2001, pp. 1–12.*

Richard M. Lloyd, "Conventional Warhead Systems Physics and Engineering Design", vol. 179, Progress in Astronautics and Aeronautics, Copyright 1998 by the American Institute of Aeronautics and Astronautics, Inc. Chapter 5, pp. 193–251.*

Richard M. Lloyd., "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99–197.

(Continued)

*Primary Examiner*—Michael Carone
*Assistant Examiner*—Troy Chambers
(74) *Attorney, Agent, or Firm*—Iandiorio & Teska

(57) ABSTRACT

A kinetic energy rod warhead with imploding charges for isotropic firing of penetrators including a hull, a core in the hull including a plurality of individual penetrators, explosive charge sections in the hull about the core, and a detonator for each explosive charge section arranged to implode the core and isotropically deploy the penetrators.

20 Claims, 8 Drawing Sheets

U.S. PATENT DOCUMENTS 2,925,965 A 2/1960 Pierce
2,988,994 A 6/1961 Fleischer, Jr. et al.
3,332,348 A 7/1967 Myers et al.
3,565,009 A 2/1971 Allred et al.
3,656,433 A 4/1972 Thrailkill et al.
3,665,009 A * 5/1972 Dickinson, Jr. ..... 548/369.7
3,757,694 A * 9/1973 Talley et al. ..... 102/495
3,771,455 A 11/1973 Haas
3,796,159 A * 3/1974 Conger ..... 102/492
3,797,359 A 3/1974 Mawhinney et al.
3,818,833 A 6/1974 Throner, Jr.
3,846,878 A 11/1974 Monson et al.
3,851,590 A 12/1974 LaCosta
3,861,314 A 1/1975 Barr
3,877,376 A * 4/1975 Kupelian ..... 102/492
3,902,424 A 9/1975 Dietsch et al.
3,903,804 A 9/1975 Luttrell et al.
3,915,092 A 10/1975 Monson et al.
3,941,059 A 3/1976 Cobb
3,949,674 A * 4/1976 Talley ..... 102/476
3,954,060 A 5/1976 Haag et al.
3,977,330 A 8/1976 Held
4,026,213 A * 5/1977 Kempton ..... 102/475
4,036,140 A 7/1977 Korr et al.
4,089,267 A 5/1978 Mescall et al.
4,106,410 A * 8/1978 Borcher et al. ..... 102/495
4,147,108 A 4/1979 Gore et al.
4,172,407 A 10/1979 Wentink
4,210,082 A 7/1980 Brothers
4,211,169 A 7/1980 Brothers
4,231,293 A 11/1980 Dahn et al.
4,289,073 A 9/1981 Romer et al.
4,376,901 A 3/1983 Pettibone et al.
4,430,941 A 2/1984 Raech, Jr. et al.
4,455,943 A 6/1984 Pinson
4,516,501 A 5/1985 Held et al.
4,538,519 A 9/1985 Witt et al.
4,638,737 A 1/1987 McIngvale
4,655,139 A 4/1987 Wilhelm
4,658,727 A 4/1987 Wilhelm et al.
4,676,167 A 6/1987 Huber, Jr. et al.
4,745,864 A 5/1988 Craddock
4,770,101 A 9/1988 Robertson et al.
4,777,882 A * 10/1988 Dieval ..... 102/489
4,848,239 A 7/1989 Wilhelm
4,922,826 A 5/1990 Busch et al.
4,957,046 A 9/1990 Puttock
4,995,573 A 2/1991 Wallow
4,996,923 A 3/1991 Theising
H1047 H 5/1992 Henderson et al.
H1048 H 5/1992 Wilson et al.
5,182,418 A * 1/1993 Talley ..... 102/475
5,223,667 A 6/1993 Anderson
5,229,542 A 7/1993 Bryan et al.
5,313,890 A * 5/1994 Cuadros ..... 102/496
5,370,053 A 12/1994 Williams et al.
5,524,524 A 6/1996 Richards et al.
5,535,679 A * 7/1996 Craddock ..... 102/494
5,542,354 A 8/1996 Sigler
5,544,589 A 8/1996 Held
5,577,431 A 11/1996 Kusters
5,578,783 A 11/1996 Brandeis
5,583,311 A 12/1996 Rieger
5,622,335 A 4/1997 Trouillot et al.
D380,784 S 7/1997 Smith
5,670,735 A 9/1997 Ortmann et al.
5,691,502 A 11/1997 Craddock et al.
5,796,031 A 8/1998 Sigler
5,823,469 A 10/1998 Arkhangelsky et al.
5,929,370 A 7/1999 Brown et al.
5,936,191 A 8/1999 Bisping et al.
6,035,501 A 3/2000 Bisping et al.
6,044,765 A 4/2000 Regebro
6,186,070 B1 2/2001 Fong et al.
6,276,277 B1 8/2001 Schmacker
6,279,478 B1 8/2001 Ringer et al. ..... 102/213
6,279,482 B1 8/2001 Smith et al. ..... 102/374
6,598,534 B1 * 7/2003 Lloyd et al. ..... 102/494
6,622,632 B1 9/2003 Spivak
6,666,145 B1 12/2003 Nardone et al.
2003/0019386 A1 * 1/2003 Lloyd et al. ..... 102/494
2004/0011238 A1 * 1/2004 Ronn et al. ..... 102/492

OTHER PUBLICATIONS

Richard M. Lloyd., "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311–406.
Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193–251.
Richard M. Lloyd, "Aligned Rod Lethality Enhanced Concept for Kill Vehicles", 10th AIAA/BMDD Technology Conf., Jul. 23–26, Williamsburg, Virginia, 2001, pp. 1–12.
U.S. Appl. No. 10/162,498, filed Jun. 4, 2002, Lloyd.
U.S. Appl. No. 10/301,302, filed Nov. 21, 2002, Lloyd.
U.S. Appl. No. 10/301,420, filed Nov. 21, 2002, Lloyd.
U.S. Appl. No. 10/384,804, filed Mar. 10, 2003, Lloyd.
U.S. Appl. No. 10/370,892, filed Feb. 20, 2003, Lloyd.
U.S. Appl. No. 10/456,391, filed Jun. 5, 2003, Lloyd et al.
U.S. Appl. No. 10/456,777, filed Jun. 6, 2003, Lloyd.
U.S. Appl. No. 10/698,500, filed Oct. 31, 2003, Lloyd.
U.S. Appl. No. 10/685,242, filed Oct. 14, 2003, Lloyd.
FAS Military Analysis Network (http://www.fas.org/man/dod–101/sys/land/m546.htm): M546 APERS–T 105–mm, Jan. 21, 1999.
FAS Military Analysis Network (http://www.fas.org/man/dod–101/sys/land/bullets2.htm): Big Bullets for Beginners, Feb. 6, 2000.
U.S. Appl. No. 10/924,104, filed Aug. 23, 2004, Lloyd.
U.S. Appl. No. 10/938,355, filed Sep. 10, 2004, Lloyd.
U.S. Appl. No. 10/960,842, filed Oct. 7, 2004, Lloyd.

* cited by examiner

FIG. 4A
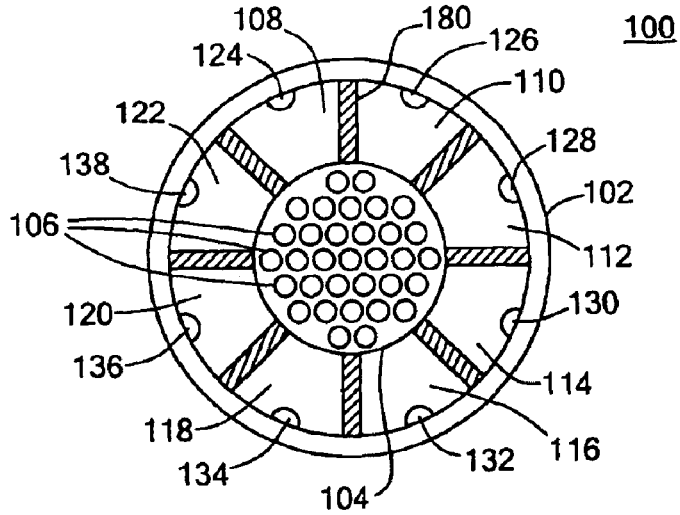
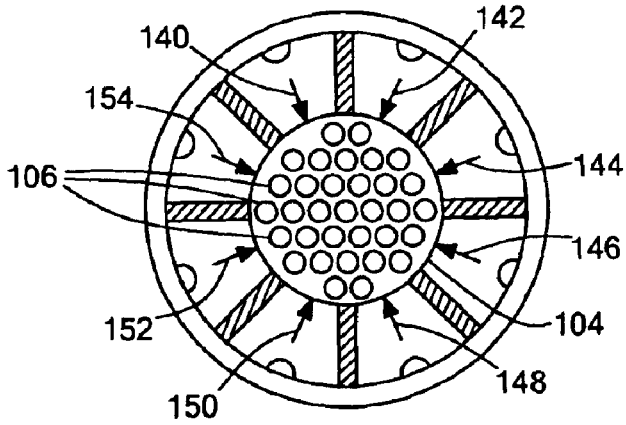
FIG. 4B
FIG. 4C
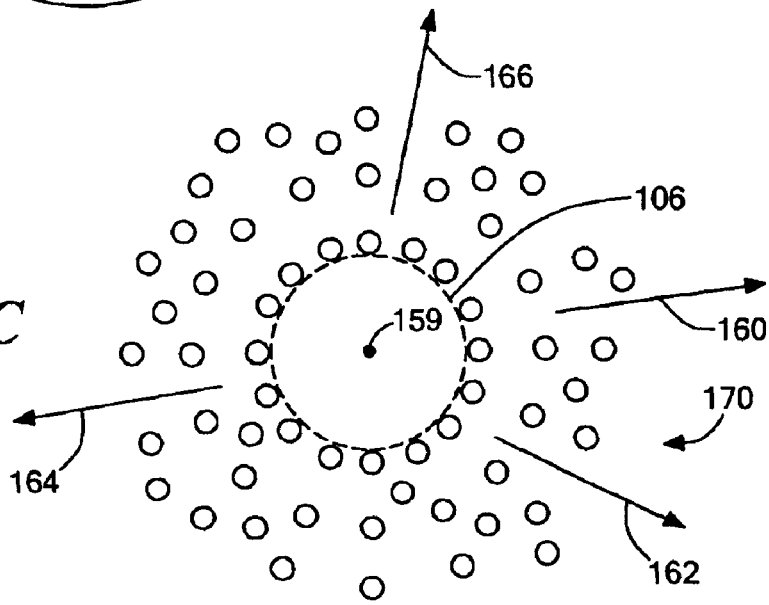

FIG. 5A
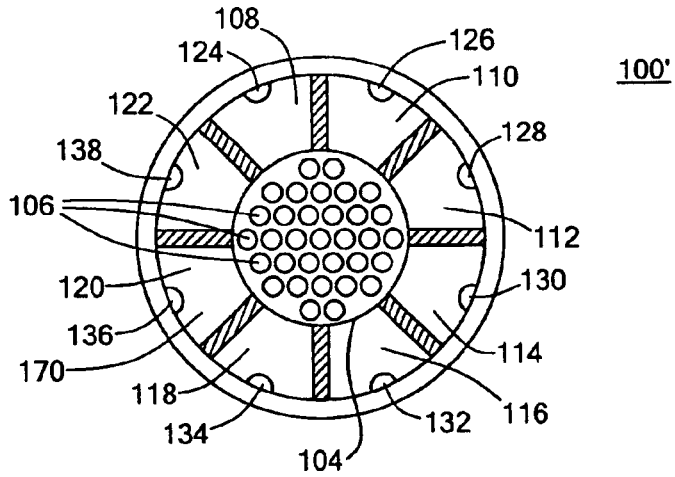
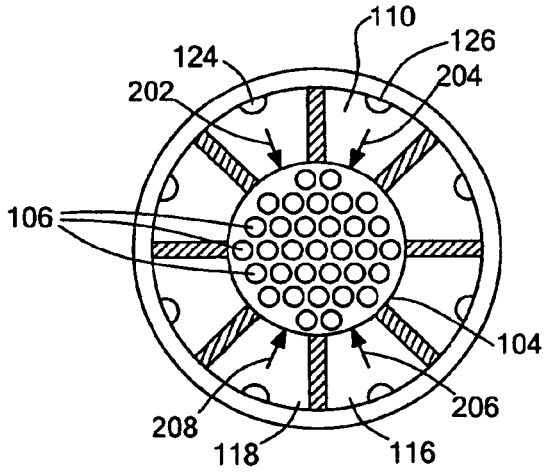
FIG. 5B
FIG. 5C
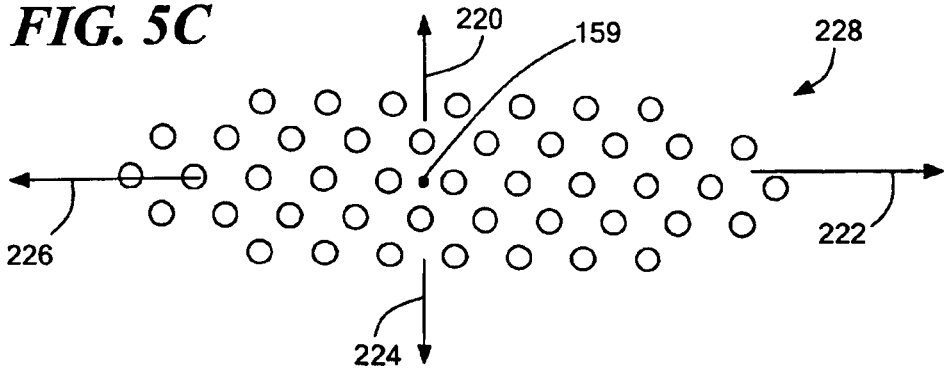

KINETIC ENERGY ROD WARHEAD WITH IMPLODING CHARGE FOR ISOTROPIC FIRING OF THE PENETRATORS

RELATED APPLICATIONS

This application claims priority of U.S. Provisional Application No. 60/406,828 filed Aug. 29, 2002. This application is related to U.S. application Ser. No. 09/938,022 filed Aug. 23, 2001. All of these applications are incorporated by reference herein.

FIELD OF THE INVENTION

This invention relates to improvements in kinetic energy rod warheads.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads.

"Hit-to-kill" vehicles are typically launched into a position proximate a re-entry vehicle or other target via a missile such as the Patriot, Trident or MX missile. The kill vehicle is navigable and designed to strike the re-entry vehicle to render it inoperable. Countermeasures, however, can be used to avoid the "hit-to-kill" vehicle. Moreover, biological warfare bomblets and chemical warfare submunition payloads are carried by some threats and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the target and, again, biological bomblets and/or chemical submunition payloads survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook, proposes a kinetic energy rod warhead.

The two primary advantages of a kinetic energy rod warheads is that 1) it does not rely on precise navigation as is the case with "hit-to-kill" vehicles and 2) it provides better penetration then blast fragmentation type warheads.

The primary components associated with a conventional kinetic energy rod warhead is a hull, or a housing, a single projectile core or bay in the hull including a number of individual lengthy cylindrical projectiles, and an explosive charge in the center of the projectiles. When the explosive charge is detonated, the projectiles are deployed to impinge upon a re-entry vehicle, missile or other target hopefully destroying it and all the submunitions such as biological warfare bomblets or chemical warfare submunition payloads it carries.

A center core explosive charge in conjunction with an aimable rod warhead may result in a complex design, may occupy an inordinate amount of space, and add mass to the warhead.

SUMMARY OF THE INVENTION

It is therefore an object of this invention to provide an aimable kinetic energy rod warhead with imploding charges for isotropic firing of penetrators.

It is a further object of this invention to provide a higher lethality kinetic energy rod warhead.

It is a further object of this invention to provide a kinetic energy warhead which deploys the penetrators in a circular or elliptical isotropic pattern to effectively destroy missiles, aircraft, re-entry vehicles and other targets.

It is a further object of this invention to provide such a kinetic energy warhead which eliminates the need for a center core charge explosive.

It is a further object of this invention to provide such a kinetic energy warhead which reduces the mass of the warhead.

It is a further object of this invention to provide such a kinetic energy warhead which simplifies the design of the warhead.

It is a further object of this invention to provides such a kinetic energy warhead which reduces the amount of space required by the explosive charges.

It is a further object of this invention to provide such a kinetic energy rod warhead with penetrators shapes which have a better chance of penetrating a target.

It is a further object of this invention to provide such a kinetic energy rod warhead with penetrators shapes which can be packed more densely.

It is a further object of this invention to provide such a kinetic energy rod warhead which has a better chance of destroying all of the bomblets and chemical submunition payloads of a target to thereby better prevent casualties.

It is a further object of this invention to provide such a kinetic energy rod warhead which provides an isotropic patter of penetrators which make the warhead appear larger than it actually is.

This invention results from the realization that isotropic firing of the projectiles of a kinetic energy rod warhead can be affected by the inclusion of a core in the hull which includes a plurality of individual penetrators therein, explosive charge sections in the hull located about the core, and a detonator for each of the explosive charge sections which are detonated to implode the core creating shock waves which interact with the center of the core and result in rebound energy that deploys the penetrators in an isotropic elliptical or circular pattern about the axis of the warhead.

This invention features an isotropic kinetic energy rod warhead with imploding charge for isotropic firing of penetrators including a hull, a core in the hull, including a plurality of individual penetrators, explosive charge sections in the hull about the core, and a detonator for each explosive charge section arranged to implode the core and isotropically deploy the penetrators.

In one preferred embodiment, the kinetic energy rod warhead may include a shield between each explosive charge section. The isotropically deployed penetrators may form a circular isotropic pattern. The isotropically deployed penetrators may form an elliptical pattern. The penetrators may be tungsten rods. The hull may be the skin of a missile. The penetrators may be lengthy metallic members. The penetrators may be made of tungsten, titanium, or tantalum. The penetrators may have a cylindrical cross section. The penetrators may have a non-cylindrical cross section. The penetrators may have a star-shape cross section, a cruciform cross section, flat ends, a non-flat nose, a pointed nose, or a wedge-shaped nose. The detonators may be chip slappers.

This invention also features a method of isotropically deploying the penetrators of a kinetic energy rod warhead, the method including the steps of: disposing a plurality of individual penetrators in the core of a hull surrounded by explosive charge section, and detonating the charge sections to implode the core and isotropically deploy the penetrators.

In one preferred embodiment, all the charged sections may be detonated simultaneously to create a circular spray pattern of penetrators. In other designs, a select subset of opposing charge sections may be detonated simultaneously to create an elliptical spray pattern of penetrators.

BRIEF DESCRIPTION OF THE DRAWINGS

Other objects, features and advantages will occur to those skilled in the art from the following description of a preferred embodiment and the accompanying drawings, in which:

FIG. 4A is a schematic cross-section view of one embodiment of the kinetic energy rod warhead with imploding charges for isotropically firing the projectiles of the subject invention;

FIG. 4B is a schematic cross-sectional view showing the simultaneous detonation of explosive sections of the warhead shown in FIG. 4A and the resulting shockwaves produced in accordance with this invention;

FIG. 4C is a schematic cross-sectional view of the kinetic energy rod warhead shown in FIG. 4B showing the circular isotropic pattern of rods produced in accordance with this invention;

FIG. 5A is a schematic cross-sectional view of another embodiment of the kinetic energy rod warhead with imploding charges for isotropically firing the projectiles of this invention;

FIG. 5B is a schematic cross-sectional view showing selective deployment of various explosive charge sections of the warhead shown in FIG. 5A in accordance with this invention;

FIG. 5C is a schematic cross-sectional view showing the isotropic elliptical pattern of rods produced by the selective deployment of detonators shown in FIG. 6B;

DISCLOSURE OF THE PREFERRED EMBODIMENT

Figure 1:
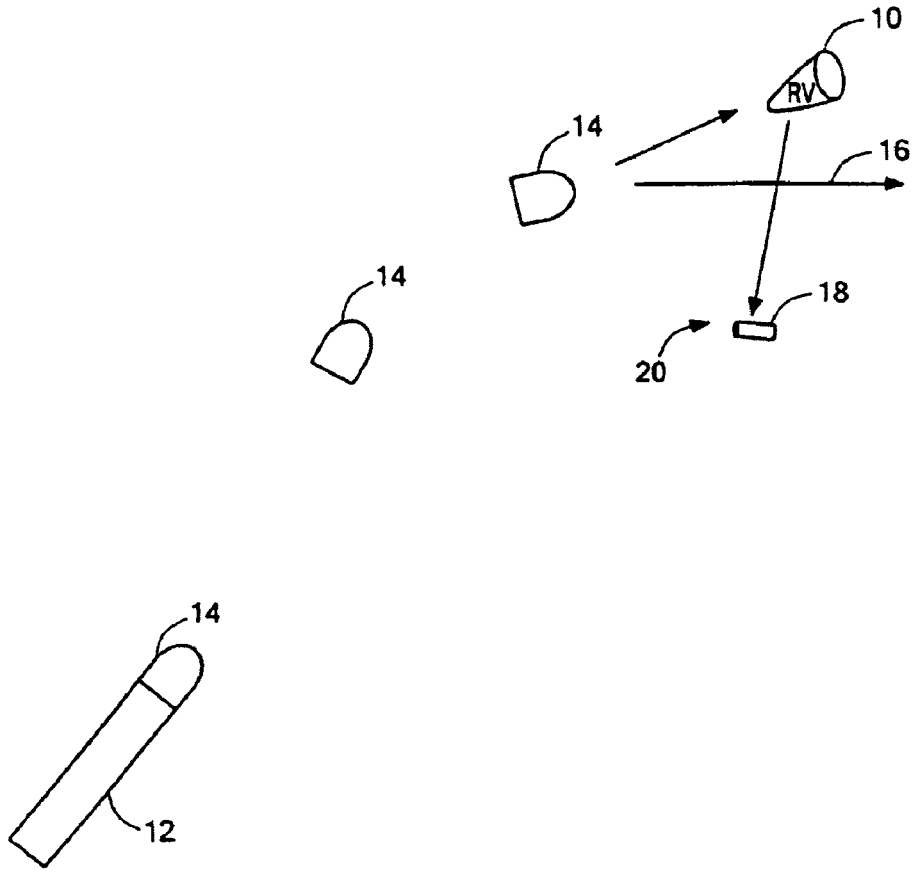
FIG. 1 PRIOR ART
FIG. 1 is schematic view showing the typical deployment of a "hit-to-kill" vehicle in accordance with the prior art.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings.

As discussed in the Background section above, "hit-to-kill" vehicles are typically launched into a position proximate a re-entry vehicle 10, FIG. 1 or other target via a missile 12. "Hit-to-kill" vehicle 14 is navigable and designed to strike re-entry vehicle 10 to render it inoperable. Countermeasures, however, can be used to avoid the kill vehicle. Vector 16 shows kill vehicle 14 missing re-entry vehicle 10. Moreover, biological bomblets and chemical submunition payloads 18 are carried by some threats and one or more of these bomblets or chemical submunition payloads 18 can survive, as shown at 20, and cause heavy casualties even if kill vehicle 14 does accurately strike target 10.

Figure 2:
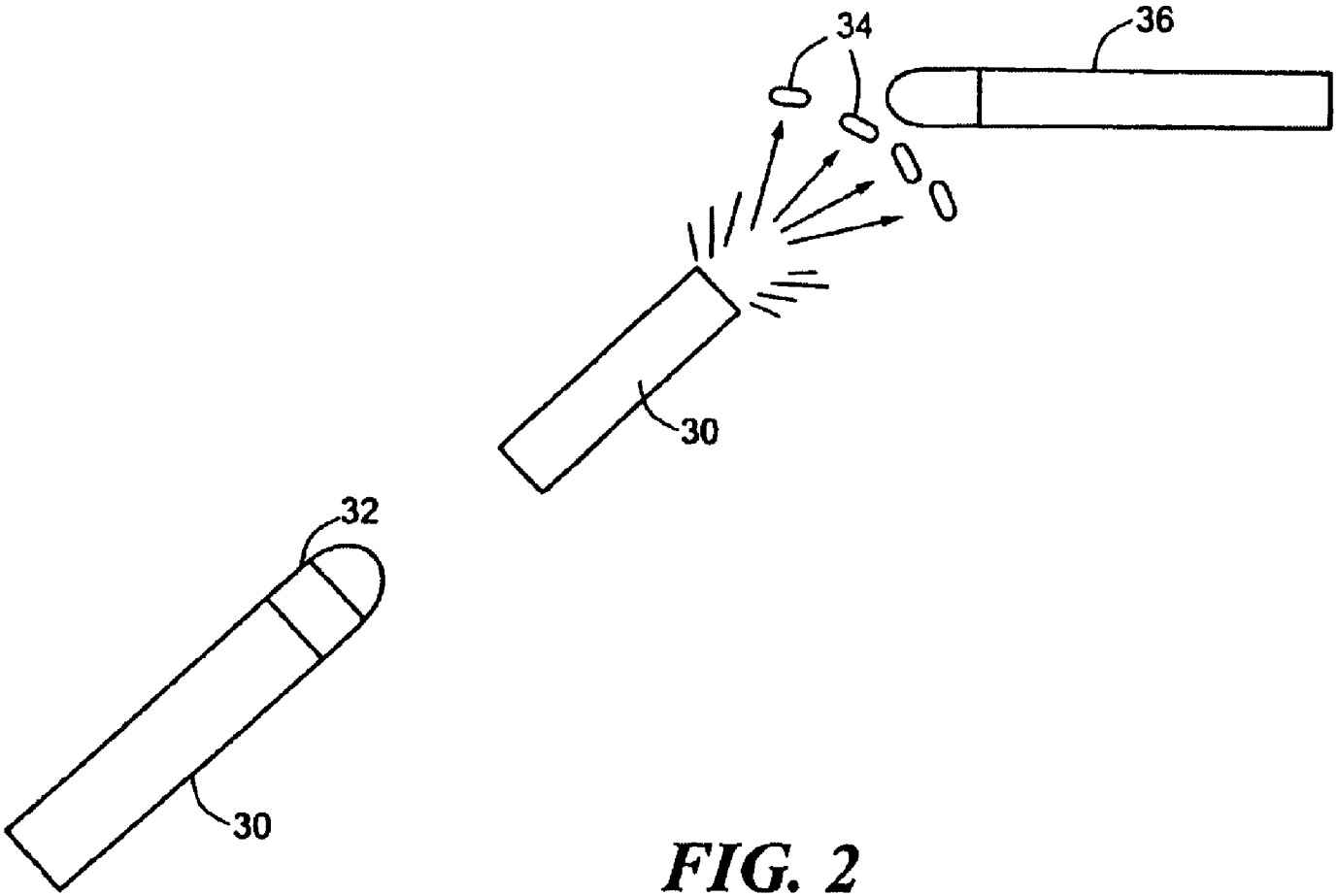
FIG. 2 PRIOR ART
FIG. 2 is schematic view showing the typical deployment of a prior art blast fragmentation type warhead.
Figure 3:
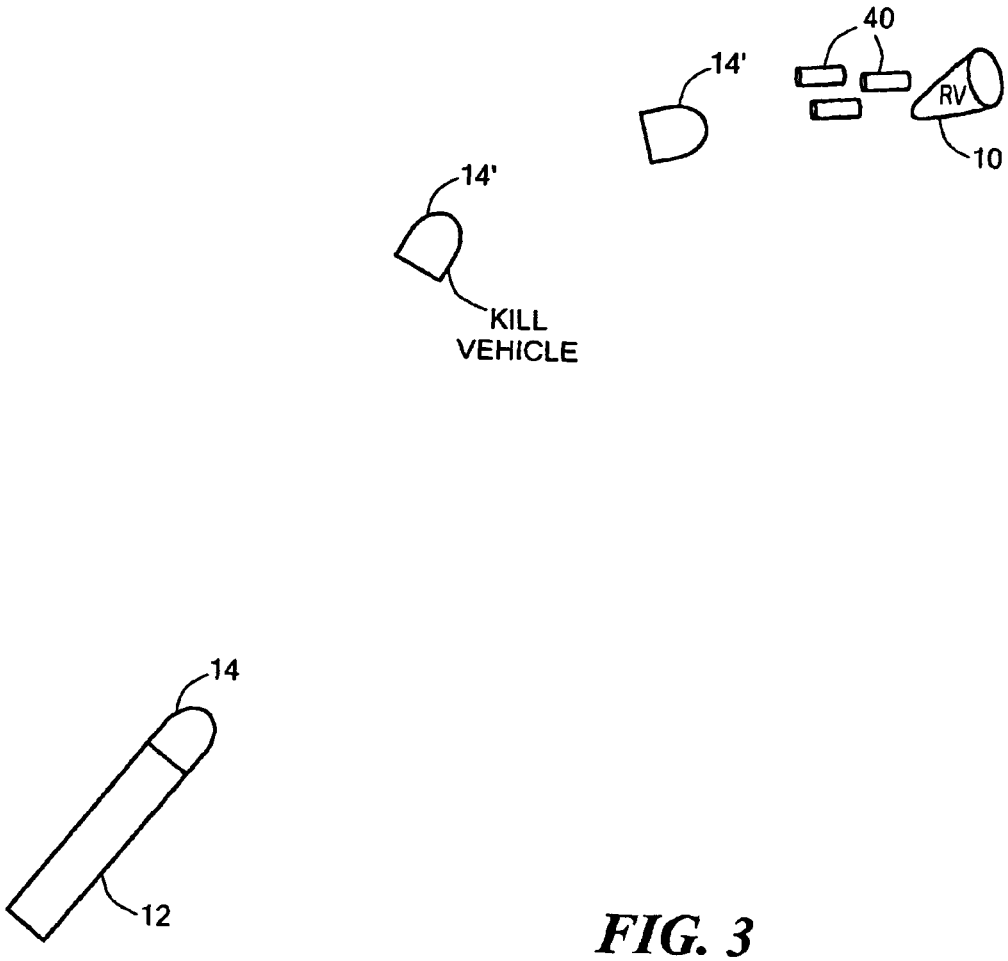
FIG. 3 is schematic view showing the deployment of a theoretical kinetic energy rod warhead system.

Turning to FIG. 2, blast fragmentation type warhead 32 is designed to be carried by missile 30. When the missile reaches a position close to an enemy re-entry vehicle (RV), missile, or other target 36, a pre-made band of metal or fragments on the warhead is detonated and the pieces of metal 34 strike target 36. The fragments, however, are not always effective at destroying the submunition target and, again, biological bomblets and/or chemical submunition payloads can survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook proposes a kinetic energy rod warhead.

One idea behind the subject invention is a warhead designed to deploy penetrators (rods or projectiles) in the trajectory path of a target by detonating various combinations of explosive charge sections located about the hull of a kinetic energy warhead to create an implosion effect which acts on the core section of the warhead with penetrators therein. The resulting rebound energy created from the implosion effect on the core section ejects the penetrators in an isotropic pattern about the axis of the warhead. The shape of the isotropic pattern of penetrators is determined by selecting which explosive charge sections are simultaneously detonated.

In one embodiment of this invention, kinetic energy warhead with imploding charges for isotropically firing projectiles 100, FIG. 4A includes hull 102 and core 104 therein. Core 104 includes a plurality of individual penetrators 106, such as tungsten, titanium, or tantalum rods, and the like, which are typically individual lengthy cylindrical projectiles. Warhead 100 further includes explosive charge sections 108–122 surrounding core 104. Detonators 124–138 (typically chip slapper type detonators) are used to initiate explosive charge sections 108–122, respectively; e.g., detonator 124 initiates explosive charge section 108; detonator 126 initiates explosive charge section 110. Detonators 124–138 and explosive charge sections 108–122 are arranged to implode on core 104 and isotropically deploy the plurality of individual penetrators 106. In one design, the simultaneous firing of detonators 124–138 initiates explosive charge sections 108–122, respectively, and produces an implosion effect, e.g. shock waves, on core 104, as shown by arrows 140–154, FIG. 4B. The imploding shock waves travel through the plurality of penetrators 106 within core 104 and reflects back after intersecting with center 159 of core 104, thus generating rebound energy, as indicated by arrows 162, 164, and 166, FIG. 4C. The energy of the rebound is sufficient to eject plurality of penetrators 106 about the warhead 100 in circular isotropic pattern 170 of penetrators about warhead 100. Once warhead 100 is in position, a circular isotropic pattern 170 of penetrators is deployed which effectively destroys enemy missiles, aircraft, RVs, biological warfare bomblets and chemical bomblets, as well as any other enemy target. A unique feature of circular isotropic pattern 170 of penetrators is that missile or warhead 100 appears larger than it actually is. Warhead 100 (e.g., an anti-ballistic missile) appears larger relative to the target because the projectiles (penetrators 106) are deployed in a 360 degree pattern (isotropic pattern 170) about the axis of warhead 100. In effect, the diameter of warhead 100 has increased by the dense radius of the spray pattern (isotropic pattern 170). These highly dense projectiles obtain high overall lethality when warhead 100 falls short of hitting the sweet spot of the payload.

As shown in FIG. 4A, kinetic energy rod warhead 100 includes explosive charge sections 124–138 in hull 102 about core 104 with penetrators 106 therein. Shields, such as shield 180, separate explosive charge sections (e.g., shield 180 separates explosive charge sections 108 and 110). Shield 180 may be made of a composite material, such as a steel core sandwiched between inner and outer lexan layers to prevent the detonation of one explosive charge section from detonating the other explosive charge sections.

In the prior art, isotropic deployment was possible but only with an explosive charge disposed in the center of a single set of projectiles. That design, in some cases, was somewhat complex, resulted in the explosive charge occupying an inordinate amount of space adding mass to the kinetic energy rod warhead and also resulted in less projectiles and hence less lethality. This prior art design in conjunction with an aimable kinetic energy device also requires added detonators and logic.

A unique feature of warhead 100 with explosive charge sections 124–138 located about core 104 is that the need for a complex center core explosive charge is eliminated, hence simplifying the design of warhead 100. The overall mass of warhead 100 is thus reduced as is the amount of space required by the explosive charge sections, hence providing more space for projectiles 106 which increases the lethality of warhead 100.

In some engagements that have a very small miss distance the predictor fuze may not know the exact location to deploy the rods (e.g., projectiles). In accordance with the subject invention, warhead 100 is designed to implode or pinch the rods (projectiles 106) away from warhead 100 without the need to add additional hardware to achieve such deployment.

In another embodiment of the subject invention, kinetic energy rod warhead 100', FIG. 5A, where like parts have been given like numbers, utilizes specific combinations of the simultaneous firing of various combinations of detonators 124–138 and their corresponding explosive charge sections 108–122 to produce a unique elliptical, or other shaped, isotropic pattern of penetrators 106. In one example, detonators 124, 126, 132, and 134 are simultaneously detonated detonating explosive charge sections 108, 110, 116, and 118, respectively. Similar to the above, shock waves, indicated by arrows 202, 204, 206, and 208, FIG. 5B, travel through the plurality of penetrators 106 within core 104 and reflect back generating a rebound energy, as shown by arrows 220, 222, 224, and 226, FIG. 5C. The rebound energy produced ejects plurality of penetrators 106 in isotropic elliptical pattern 228. The results of the elliptical pattern 228 is that a significant overlay of penetrators 106 is produced over an enemy RV, or other enemy target compared to the circular spray pattern, as previously discussed above.

Figures 6, 7, 8, 9, 10, 11:
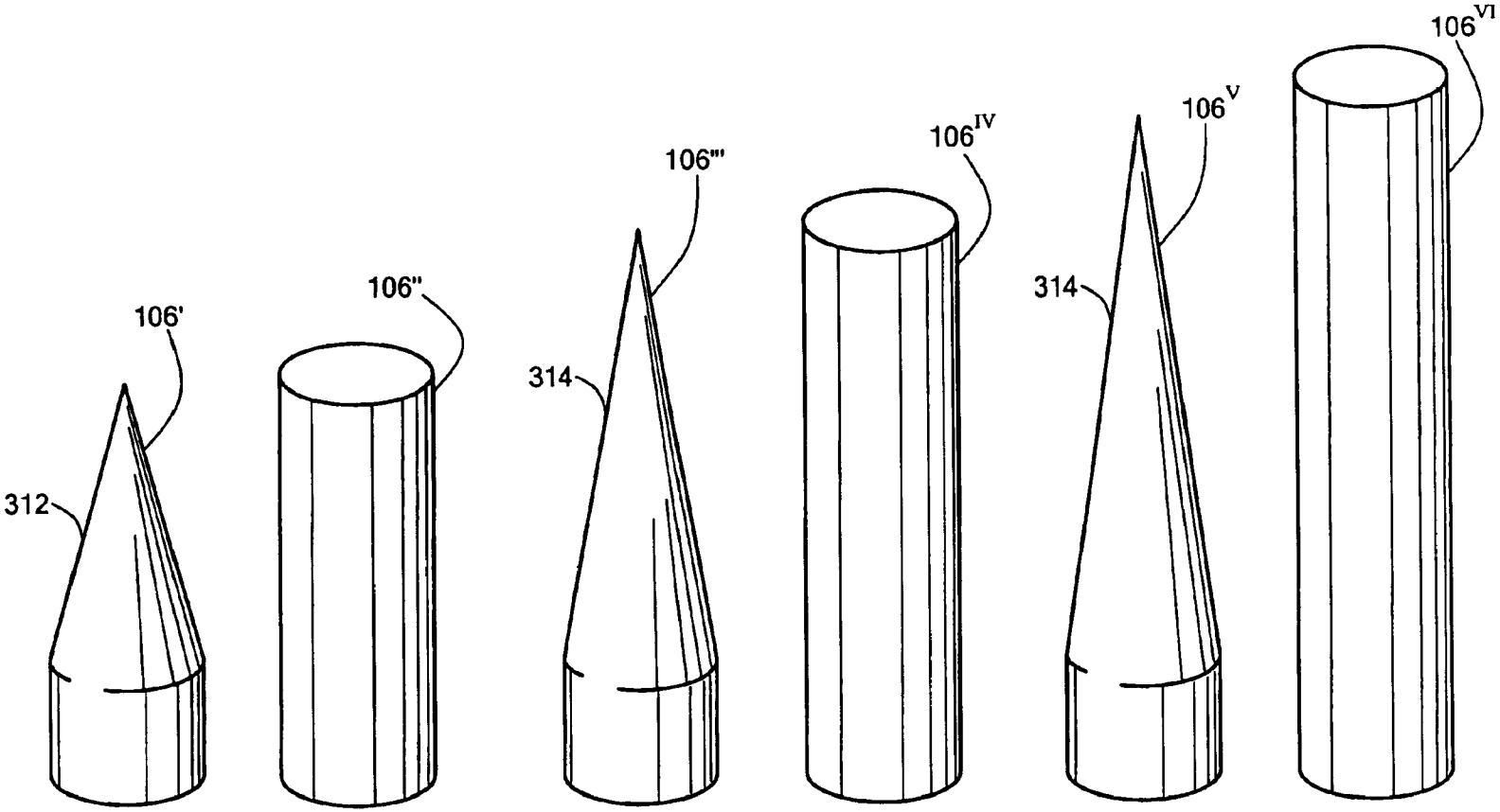
FIGS. 6–13 are three-dimensional views showing different projectile shapes useful in the kinetic energy rod warhead of the subject invention.
Figure 13:
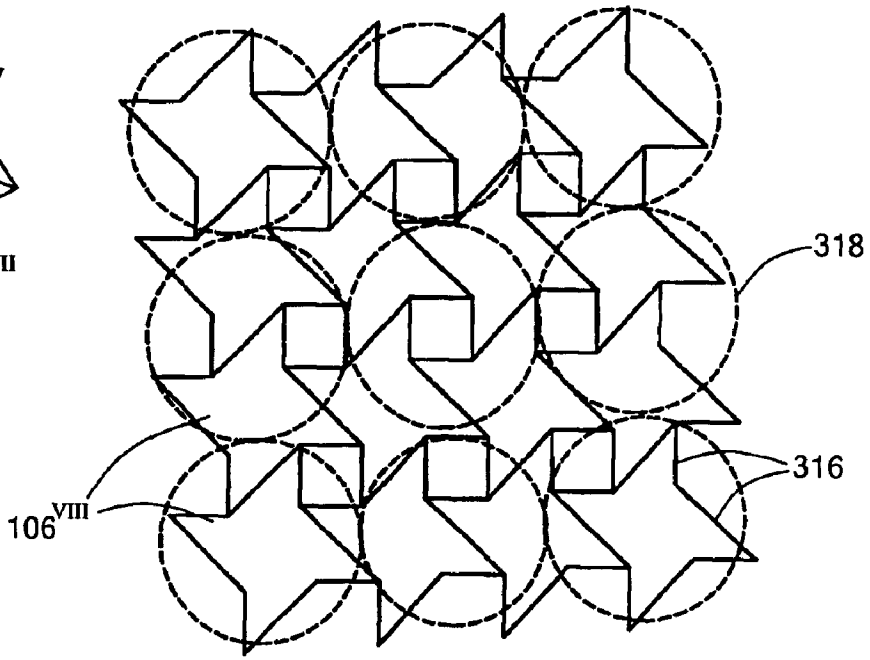

Thus far, the penetrators (projectiles) have been shown to be lengthy cylindrical members but that is not a limitation of the subject invention. Non-cylindrical cross section penetrators (projectiles) may provide improved strength, weight, packaging efficiency, penetrability, and/or lethality. For example, penetrator 106', FIG. 6 which includes lengthy pointed sections 312 as compared to short cylindrical cross sectional penetrators 106", FIG. 7. Penetrator 106''', FIG. 8 includes longer pointed section 314 compared to cylindrical cross section projectile $\mathbf{106}^{IV}$, FIG. 9. FIG. 10 shows penetrators $\mathbf{106}^{V}$ with even longer pointed section 314 compared to lengthy cylindrical cross section penetrators $\mathbf{106}^{VI}$, FIG. 11.

Figure 12:
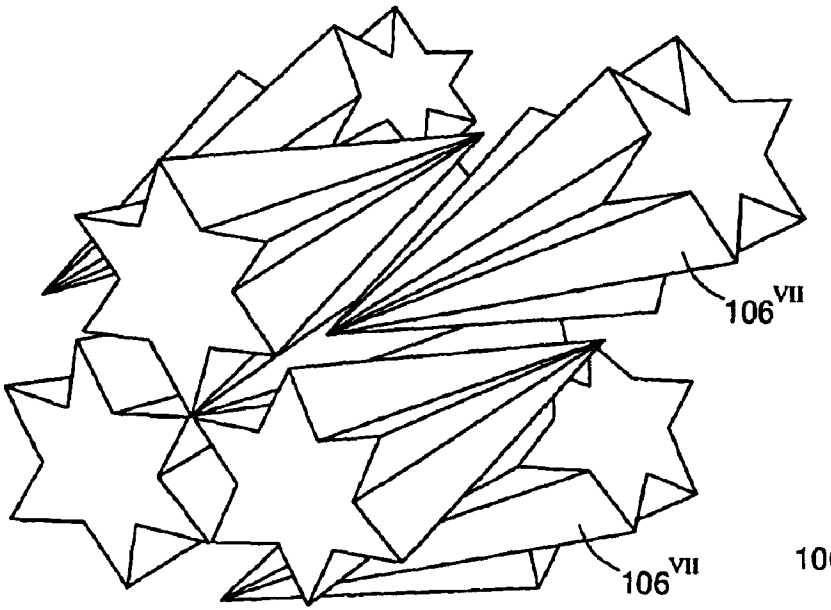

FIG. 12, in contrast, shows penetrators $\mathbf{106}^{VII}$ with a star shaped cross section and having pointed ends as shown while penetrators $\mathbf{106}^{VIII}$ have petals 316 designed such that many more penetrators can be packaged in the same space occupied by fewer cylindrical cross section penetrators 318 shown in phantom.

The penetrator (projectile) shapes disclosed herein have a better chance of penetrating a target and can be packed more densely. As such, the kinetic energy rod warhead of this invention has a better chance of destroying all of the bomblets and chemical submunition payloads of a target to thereby better prevent casualties.

The result of the kinetic energy rod warhead 100 with isotropically deployable projectiles, but lacking a large center explosive core, is a kinetic energy rod warhead design which is extremely versatile as discussed above. Further details concerning kinetic energy rod warheads and penetrators (projectiles) are disclosed in co-pending U.S. patent application Ser. No. 09/938,022 filed Aug. 23, 2001; U.S. patent application Ser. No. 10/162,498 filed Jun. 2, 2002; application Ser. No. 10/301,420 filed Nov. 21, 2002 entitled KINETIC ENERGY ROD WARHEAD WITH ISOTROPIC FIRING OF THE PROJECTILES; and application Ser. No. 10/301,302 filed Nov. 21, 2002 entitled TANDEM WARHEAD. See also the application filed on an even date herewith entitled KINETIC ENERGY ROD WARHEAD DEPLOYMENT SYSTEM by the same inventor. All of these applications are incorporated by reference herein.

Figure 14:
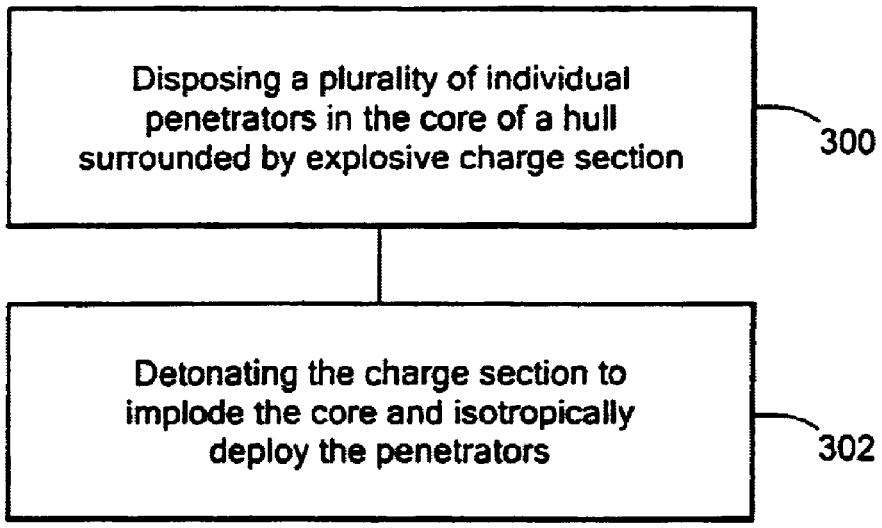
FIG. 14 is a flow chart showing the primary steps of the method of isotropically deploying the penetrators of the kinetic energy rod warhead of this invention.

The method of isotropically deploying the penetrators of a kinetic energy warhead of this invention includes the steps of: disposing a plurality of individual penetrators 106, FIG. 4A in core 104 of hull 102 surrounded by explosive charge sections 108–122, step 300, FIG. 14; and detonating charge sections 108–122, FIG. 4A to implode core 104 and isotropically deploy penetrators 106, FIG. 4C, step 302, FIG. 14. In one design, all the charge sections are detonated simultaneously, e.g., explosive charge sections 108–122, FIG. 4A to create a circular spray pattern 170, FIG. 4C. In other designs, a select subset of opposing charge sections, for example charge sections 108, 110, 112, and 114, FIG. 5A are detonated simultaneously to create an elliptical spray pattern 228, FIG. 5C.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A kinetic energy rod warhead with an imploding charge for isotropic firing of penetrators comprising:

a hull;

a core in the hull including a plurality of individual penetrators;

explosive charge sections in the hull about the core; and a detonator for each explosive charge section arranged to implode on the core and isotropically deploy the penetrators;

said detonators simultaneously detonated in operation to trigger all or select explosive charge sections to implode on the core for isotropically deploying the penetrators.

2. The kinetic energy rod warhead of claim 1 further including a shield between each explosive charge section.

3. The kinetic energy rod warhead of claim 1 in which the isotropically deployed penetrators form a circular isotropic pattern.

4. The kinetic energy rod warhead of claim 1 in which the isotropically deployed penetrators form an elliptical pattern.

5. The kinetic energy rod warhead of claim 1 in which the penetrators are tungsten rods.

6. The kinetic energy rod warhead of claim 1 in which the hull is the skin of a missile.

7. The kinetic energy rod warhead of claim 1 in which the penetrators are lengthy metallic members.

8. The kinetic energy rod warhead of claim 1 in which the penetrators are made of tungsten.

9. The kinetic energy rod warhead of claim 1 in which the penetrators have a cylindrical cross section.

10. The kinetic energy rod warhead of claim 1 in which the penetrators have a non-cylindrical cross section.

11. The kinetic energy rod warhead of claim 1 in which the penetrators have a star-shape cross section.

12. The kinetic energy rod warhead of claim 1 in which the penetrators have a cruciform cross section.

13. The kinetic energy rod warhead of claim 1 in which the penetrators have flat ends.

14. The kinetic energy rod warhead of claim 1 in which the penetrators have a non-flat nose.

15. The kinetic energy rod warhead of claim 1 in which the penetrators have a pointed nose.

16. The kinetic energy rod warhead of claim 1 in which the penetrators have a wedge-shaped nose.

17. The kinetic energy rod warhead of claim 1 in which the detonators are chip slappers.

18. A method of isotropically deploying the penetrators of a kinetic energy rod warhead, the method comprising:

disposing a plurality of individual penetrators in the core of a hull surrounded by explosive charge section; and detonating the charge sections to implode on the core and isotropically deploy the penetrators.

19. The method of claim 18 in which all the charged sections are detonated simultaneously to create a circular spray pattern of penetrators.

20. The method of claim 19 in which a select subset of opposing charge sections are detonated simultaneously to create an elliptical spray pattern of penetrators.

* * * * *